United States Patent [19]

Bennett et al.

[11] Patent Number: 4,880,517

[45] Date of Patent: Nov. 14, 1989

[54] CATALYTIC POLYMER ELECTRODE FOR CATHODIC PROTECTION AND CATHODIC PROTECTION SYSTEM COMPRISING SAME

[75] Inventors: John E. Bennett, Painesville; Donald S. Novak, Chardon; Thomas A. Mitchell, Mentor, all of Ohio

[73] Assignee: ELTECH Systems Corporation, Boca Raton, Fla.

[21] Appl. No.: 57,592

[22] Filed: Jun. 2, 1987

Related U.S. Application Data

[63] Continuation of Ser. No. 772,443, Sep. 6, 1985, abandoned, which is a continuation-in-part of Ser. No. 656,634, Oct. 1, 1984, abandoned.

[51] Int. Cl.[4] ..... G23F 13/00

[52] U.S. Cl. ..... 204/196; 204/147; 204/290 F

[58] Field of Search ..... 204/147, 196, 290 F, 204/294

[56] References Cited

U.S. PATENT DOCUMENTS

| | | | |
|---|---|---|---|
| Re. 29,419 | 9/1877 | Decraene | 204/290 |
| 3,133,872 | 5/1964 | Miller et al. | 204/196 |
| 3,629,007 | 12/1971 | Kilduff | 136/27 |
| 3,751,301 | 8/1973 | Kilduff | 136/26 |
| 3,798,142 | 3/1974 | Evans | 204/147 |
| 3,868,313 | 2/1975 | Gay | 204/196 |
| 4,117,065 | 9/1978 | Tsien et al. | 264/105 |
| 4,118,294 | 10/1978 | Pellegri | 204/129 |
| 4,186,075 | 1/1980 | Kempter et al. | 204/294 |
| 4,255,241 | 3/1981 | Kroon et al. | 204/147 |
| 4,285,796 | 8/1981 | Stoner et al. | 204/290 |
| 4,360,417 | 11/1982 | Reger et al. | 204/290 |
| 4,414,092 | 11/1983 | Lu et al. | 204/294 |
| 4,425,217 | 1/1984 | Beer | 204/290 |
| 4,454,169 | 6/1984 | Hinden et al. | 427/125 |
| 4,459,189 | 7/1984 | Vance et al. | 204/106 |
| 4,473,450 | 9/1984 | Nayak et al. | 204/147 |
| 4,502,929 | 3/1985 | Stewart et al. | 204/147 |
| 4,511,442 | 4/1985 | Pellegri | 204/98 |
| 4,528,084 | 7/1985 | Beer et al. | 204/290 |
| 4,619,753 | 10/1986 | Christen et al. | 204/290 F |

FOREIGN PATENT DOCUMENTS

| | | |
|---|---|---|
| 104493 | 5/1966 | Denmark . |
| 4834293 | 10/1973 | Japan . |
| 51123941 | 5/1978 | Japan . |

*Primary Examiner*—T. Tung

*Attorney, Agent, or Firm*—John J. Freer

[57] ABSTRACT

A catalytic polymer electrode compries a current conducting polymer body forming an electrode base which is provided with catalytic valve metal particles fixed to its surface. A current conducting body of carbon filled thermoplastic polymer is heated to soften its outer surface, and the catalytic valve metal particles are pressed onto its softened surface and thereby attached to the surface of the polymer body. Such a catalytic polymer electrode used as an anode in an impressed-current cathodic protection system comprises a catalyst to provide a reduced oxygen potential. Such catalytic polymer anodes may be applied in systems for impressed current cathodic protection of reinforced concrete structures, such as bridge decks, support members, parking garages, or of buried or submerged steel structrues such as gas and oil pipelines, offshore production platforms, fuel storage tanks, well casings.

4 Claims, No Drawings

CATALYTIC POLYMER ELECTRODE FOR CATHODIC PROTECTION AND CATHODIC PROTECTION SYSTEM COMPRISING SAME

This is a continuation of application Ser. No. 772,443, filed Sept. 6, 1985, now abandoned, which in turn is a continuation-in-part of application Ser. No. 656,634 filed Oct. 1, 1984, now abandoned.

TECHNICAL FIELD

The present invention relates to catalytic polymer electrodes which comprise an electrocatalyst applied to a current conducting polymer body forming an electrode base. Use of the catalytic polymer electrode in an impressed-current cathodic protection system and a method of making the catalytic polymer electrode are also disclosed.

BACKGROUND ART

It is known that cathodic protection is effective to prevent corrosion of reinforcing steel in concrete bridge decks, support structures, and parking garages, which are subject to extensive damage by corrosion of the steel reinforcement due to the presence of salt and moisture in the normally alkaline concrete environment. Such damage of reinforced concrete by corrosion results more particularly from the practice of spreading large amounts of salt on roads in winter, while coastal structures are attacked by seawater and salt spray.

Existing cathodic protection techniques for reinforcing steel are nevertheless limited by the anodes presently available for this purpose, which must have a long life and a chemically resistant anode structure that is readily adaptable from case to case according to the size and configuration of the reinforced concrete structure to be cathodically protected from corrosion.

A known type of polymer anode commercially availiable for use in impressed-current cathodic protection systems consists of a carbon loaded, current conducting polymer body with a copper core and operates at a current density limited to a maximum of about 0.02 $A/m^2$ to avoid causing damage to the polymer anode surface.

Another type of anode which is used for cathodic protection of reinforcing steel consists of carbon fibers which are placed in a groove in the concrete, the groove then being filled with a grout of electronically conductive carbon-loaded backfill. Here again, the use of carbon presents serious limitations, since this material is subject to high operating voltages and therefore a limited lifetime as an anode. This is a serious limitation since replacement of anodes embedded in concrete is very difficult. This type of anode also has a high electronic resistivity, so that current can be carried longitudinally only over very short distances through the carbon fibers.

Other anodes which are traditionally used for impressed current cathodic protection are constructed of platinized titanium or platinized tantalum with a more electronically conductive copper core. Such electrodes are often used for cathodic protection of underground pipelines, well casings, ship hulls, jetties, drilling rigs, and oil platforms. These electrodes are expensive and must therfore be used at a higher current density, up to 1000 $A/m^2$ in some cases. The expense of such platinized titanium or tantalum electrodes entails special design problems since a very low current density must be applied to the structure being cathodically protected. This results in a mismatch of current density between anode and cathode. Various system designs attempt to accomodate this mismatch, usually by installation of small anodes at certain locations which are intended to protect large structures over great distances. Unfortunately, this often leads to unforeseen current density disparities and inadequate protection of more distant parts of the structure.

It is understood that continuous, wire-like flexible anodes for example are more suitable for cathodic protection of many structures such as underground pipelines in particular but until now such anodes were not capable of functioning over extended periods of time.

Numerous composite electrodes have moreover been proposed which comprise a polymer material combined with a dispersed conductive filler, or an electrocatalyst, or both. The state of the art relating to such composite electrodes may be illustrated for example by U.S. Pat. No. 3,629,007; 3,751,301; 4,118,294; 4,473,450 and European Patent Application No. 0 067 679.

DISCLOSURE OF INVENTION

An object of the invention is to provide long life catalytic polymer electrodes which comprise an electrocatalyst applied to the surface of a current conducting polymer body forming an electrode base.

Another object of the invention is to provide a catalytic polymeric anode which presents substantially the same advantages as known carbon loaded, current conducting polymeric anodes for cathodic protection systems, but which can operate at a significantly reduced potential with an extended service life at a higher current density.

A further object of the invention is to provide such a catalytic polymeric anode with a long service life which is more particularly suitable for the cathodic protection of reinforced concrete structures, such as bridge decks, parking garages, and coastal structures exposed to seawater and salt spray.

Another object of the invention is to provide such a catalytic polymeric anode which is more particularly suitable for the cathodic protection of underground pipelines, well casings, ship hulls, jetties, drilling rigs, oil platforms, and the like.

These objects are met according to the invention as set forth in the claims.

According to the invention, a catalytic polymer electrode is provided with catalytic valve metal particles which are fixed to the surface of a current conducting polymer body forming an electrode base.

The catalytic polymer electrode according to the invention may comprise an electrode base formed of any suitable current conducting polymer body. A carbon loaded polymer may advantageously form a current conducting polymer body to provide such an electrode base.

The catalytic polymer electrode according to the invention will preferably comprise an electrode base consisting of a current conducting body made from thermoplastic polymer compounds. The preferred thermoplastic resins include: polyolefins such as polymers of ethylene and/or propylene; halocarbon polymers such as polyvinyl chloride, polyvinylidene fluoride and halogen substituted olefinic polymers; styrenic polymers such as polystyrene, and copolymers of styrene with acryonitrile, etc; polyamides such as polycaprolactam; the thermoplastic polyesters; and the acrylic resins such as polyacrylates and polymethacrylates. However, higher strength thermoplastics including polyimides; polyarylene resins, such as polycarbonates, polysulfones and polyphenylene oxides and sulfides; and various heterocyclic resins may also be used.

The invention provides a particularly simple method of manufacturing such a catalytic polymer electrode with an extended service life. According to the method the polymer electrode is made by heating a current conducting body of thermoplastic polymer so as to produce an electrode base with a softened external layer of the thermoplastic polymer and pressing catalytic valve metal particles onto said softened external layer of the polymer. The catalytic valve metal particles may advantageously be heated before pressing. The pressing being carried out so that upon cooling, a uniform outer layer of said catalytic valve metal particles anchored to the surface of the electrode base is obtained.

It has been found that when the carbon loaded polymer forming the electrode body is admixed with up to 50% by weight of conductive fibers such as carbon or metallic fibers the polymer electrode obtained upon extrusion of such material around a metallic core, heating of the current conducting body and pressing the catalytic valve metal particles has advantageous properties. Such electrodes are found to sustain high electrical currents while avoiding an excessive voltage drop within the electrode.

Although the amount of fibers may be as high as 50 weight % the best results are obtained when the amount of fibers in the carbon loaded polymer is kept in the range of 5 to 30% by weight of the polymer. This is based on finding that the polymer body made with more than 50% of fibers loses its mechanical properties and when the amount of fibers is kept below 5% the conductivity of the polymer body is not adequate. Various conductive fibers may be employed e.g. carbon, glassy carbon, nickel, copper, aluminium or stainless steel fibers.

Use of an electrode base of thermoplastic polymer is particularly advantageous in that it allows a catalytic polymer electrode to be produced according to the invention by this extremely simple and reproducible method, while ensuring an excellent fixation and electrical connection of said catalytic particles to the surface of the electrode base.

The catalytic polymer electrode according to the invention may thus be produced in a highly simplified manner in the form of a continuous electrode of any suitable cross-section, for example in the form of a wire, rod, strip, or sheet.

This possibility of very simply and reproducibly manufacturing continuous electrodes of any desired cross-section and length according to the invention is particularly important with regard to the industrial manufacture of continuous anodes for cathodic protection systems, which generally entail very high installation costs, and more particularly require anodes which are readily adaptable to the particular configuration of the structure to be protected from case to case.

The electrode base formed of current conducting, carbon loaded polymer will advantageously comprise an internal metallic reinforcing core, preferably a copper core, which is embedded in the carbon loaded polymer body, in order to allow the catalytic polymer electrode to conduct a sufficiently high electrical current while avoiding an excessive voltage drop within the electrode.

The catalytic particles used in the invention will advantageously consist of one of the valve metals: titanium, niobium, tantalum, zirconium, or an alloy thereof which exhibits subtantially the same anodic film-forming properties as these valve metals.

Catalytic particles of titanium sponge which have an irregular size and shape and are readily deformable may be advantageously pressed into a coherent layer adhering to the electrode base formed of a current conducting polymer body.

These catalytic valve metal particles are advantageously activated with an electrocatalyst which provides a reduced oxygen potential and which may comprise at least one precious metal selected from the group consisting of ruthenium, palladium, iridium, platinum, and rhodium in the metallic state or, preferably, as an oxide.

A catalytic polymer anode according to the invention provided good results with catalytic particles of titanium sponge comprising a ruthenium based catalyst.

A very small amount of precious metal may thus be applied to the catalytic valve metal particles and the proportion of precious metal applied may advantageously be at most in the order of 1% by weight of said catalytic particles, but a proportion of precious metal considerably below 1% may be advantageously applied in accordance with the invention. This proportion of precious metal applied may preferably lie in the range from 0.1% to about 1.0%, but may if necessary amount up to about 5%.

The catalytic valve metal particles may be advantageously applied according to the invention with a particle loading in the order of 10 to 100 grams per square meter of the electrode base surface to which they are applied, but this loading may amount to up to 500 grams per square meter or more in some cases.

The catalytic particles employed according to the invention may be prepared in any suitable manner, for example by a process as described in U.S. Pat. No. 4,454,169, or in U.S. Pat. No. 4,425,217, which are hereby incorporated by reference herein.

The catalytic particles may be simply applied, fixed, and electrically connected by pressing them onto the surface of a heated thermoplastic polymer body forming the anode base. These particles may thus be applied by means of rollers, or by drawing the polymer body through a die. An electronically conductive glue or adhesive may likewise be used for their electrical connection.

Catalytic polymer electrodes according to the invention are especially suitable as anodes in impressed current cathodic protection systems in which current densities do not exceed 500 $A/m^2$ and are preferably between 10 and 350 $A/m^2$. The catalytic polymer anode of the invention is particularly effective in protecting buried or submerged steel strucures such as gas and oil pipelines.

Different test results have shown that the catalytic anode can operate at a much higher current density and a much lower potential than the conventional polymer anode. Moreover, it has been established that catalytic valve metal particles such as are applied according to the invention retain their catalytic activity under extremely harsh anodic corrosion conditions, during operation at a many times higher anode current density.

The catalytic anode according to the invention may thus be expected to exhibit a long service life in cathodic protection systems, due to the fact that it can operate at a much lower potential, and can thereby protect the current conducting polymer body from damage by oxidation during operation at a relatively high anode current density.

The activated polymer anode of the invention may be in the form of cable, sheet, wire, perforated plate or any other convenient form. However, it has been established that, for the anode of the invention in which the active catalytic material (e.g. $RuO_2$) is carried on a conductive valve metal carrier and the carrier with the catalyst thereon is supported on a carbon loaded thermoplastic polymer, the preferred form is the cable.

The invention may further be illustrated by the following examples:

EXAMPLE I

A catalytic polymer anode was made by applying catalytic titanium particles to an anode base consisting of a conventional current conducting polymer anode of carbon loaded polyolefin with a copper core, which is a conventional, wire-shaped polymer anode (diameter 1 cm) commercially available for impressed-current cathodic protection.

For this purpose, the polymer anode body was heated to 120° C. for 10 minutes and catalytic titanium particles were then pressed with a roller onto the softened anode surface, which provided good adherence of the catalytic particles to the anode surface.

The catalytic particles thus applied consisted of activated titanium sponge with a particle size in the range from 300 to 840 micrometers. These sponge particles were activated by impregnation with an activating solution comprising 2.38 g $RuCl_3$ aq.(40 wt % Ru), and 3.36 g tetra-ortho-butyl titanate dissolved in 3.2 ml concentrated HCl and 80 ml butylalcohol, then drying at 100° C. in air for 120 minutes, and heat treating the dried particles in air at 300° C. for 30 minutes, at 425° C. for 30 minutes, and finally at 500° C. for 10 minutes. This activating treatment was carried out 2 times and the catalytic particles thus obtained contained 1% Ru by weight of Ti.

The total loading of the catalytic particles applied as described corresponded to 100 $g/m^2$ of the polymer anode surface.

The catalytic anode thus obtained was tested in a concrete block containing a steel reinforcement bar, and compared with a conventional polymer anode (without catalyst) as described above. For this purpose, the catalytic anode and the conventional polymer anode were symmetrically positioned in the same vertical plane and on opposite sides of a vertical steel reinforcement bar (at 5 cm from the steel bar), and each anode was provided with a reference electrode (Ag/AgCl) for measuring its single electrode potential (S.E.P).

A block of concrete (9×13×30 cm) containing 8.8 $kg/m^3$ of NaCl was then cast around the anodes and the steel bar so that they were embedded while their top ends projected from the concrete block for connection to a D.C. supply source.

An impressed current corresponding to an anode current density of 0.11 $A/m^2$ was passed through the concrete block between the steel bar connected to the negative terminal of the D.C. source and the anodes connected to the positive terminal, while the anode potentials were measured over a test period of 1 month.

The described catalytic anode operated for 30 days at a constant potential of 0.390 V vs. CSE (Copper Sulfate Electrode). On the other hand, the conventional polymer anode exhibited a potential which rose from about 1 V to about 2 V vs. CSE in the first 8 days, decreased slightly to 1.8 V after 20 days, then increased slowly once more to 2.0 V after 30 days.

The catalytic anode thus operated at a constant potential up to about 1.6 V lower than the non-catalytic anode, while it may be noted that the anode current density applied in this test is several times higher than that at which the described conventional polymer anode can be operated with a satisfactory service life.

The catalytic anode according to the invention may thus be expected to exhibit a long service life in cathodic protection systems, due to the fact that it can operate at a much lower potential, and can thereby protect the current conducting polymer body from damage by oxidation during operation at a relatively high anode current density. The catalytic anode according to the invention may be expected to be functional up to about 500 $A/m^2$.

EXAMPLE II

A catalytic polymer anode 150 meters long was made by applying catalytic particles to an anode base consisting of a carbon loaded polyolefin with a copper core. The anode base was first prepared by extruding Union Carbide conductive thermoplastic compound DHDA 7707 around a conductive copper core of #16 AWG wire (U.S. standard for wire size).

Catalyst was prepared by activating 500 grams of titanium sponge with a particle size in the range of 300 to 840 micrometers. After rinsing in acetone and drying at 120° C., the titanium particles were activated by mixing with an activating solution comprising 17.31 grams $RuCl_3$ aq. (43 wt. % Ru) in 250 ml acetone, drying for 2 hours, prebaking at 340° C. for 30 minutes, and postbaking at 400° C. for 40 minutes. This activating treatment was carried out two times and the catalytic particles thus obtained contained 3% Ru by weight of titanium.

Catalyst was then continuously applied in a separate step by passing the anode base through a tube furnace at about 385° C. to rapidly heat the polymer surface, passing through a fixed bed of heated catalyst particles, and passing through a series of rollers to press the catalyst particles onto the surface of the anode base. The anode thus prepared was catalyzed with 330 grams of said particles per square meter of anode surface.

110 meters of this anode was then placed in a porous duct for the purpose of protecting lead-sheathed utility cables. 0.93 amps was applied to the anode resulting in a current density at the anode surface of 0.35 amps per square meter. Cable to soil potentials were acceptable for cathodic protection of the cable, ranging from 0.685 to 0.90 volts vs. a $CuSO_4$ reference electrode, and contact resistance was measured to be equivalent to, or slightly lower than, cast iron anodes. Ground anode potentials measured vs. a $CuSO_4$ reference electrode along the length of the anode at even intervals remained constant, and were reported as follows:

| Anode Length [meters] | Measured Potential [Volts] |
|---|---|
| NORTH END | +3.20 |
| | +3.19 |
| 17 | +3.14 |
| | +3.15 |

-continued

| Anode Length [meters] | Measured Potential [Volts] |
|---|---|
| 34 | +3.12 |
| | +3.05 |
| 51 | +3.04 |
| | +3.00 |
| 68 | +3.02 |
| | +3.01 |
| 85 | +2.98 |
| | +2.96 |
| 102 | +2.92 |
| | +3.04 |
| SOUTH END | +3.11 |

EXAMPLE III

A catalytic polymer anode 100 meters long was made by applying catalytic particles to an anode base consisting of carbon loaded polyolefin with a copper core. The anode base was first prepared by extruding Union Carbide conductive thermoplastic compound DHOA 7707 around a conductive copper core of #8 AWG wire.

Catalyst particles were prepared and were applied to the anode base as described in Example II. An anode thus prepared was catalyzed with 300 grams of said particles per square meter of anode surface.

A representative sample of this anode 10 centimeters long was operated in 1.0 Molar $H_2SO_4$ at 0.327 A, equivalent to a surface current density of 100 amps per square meter. This anode has operated for over 910 hours at a cell voltage of 2.6 to 2.7 volts without any sign of failure. An anode base of carbon loaded thermoplastic without catalyst particles failed after only 20 hours of operation, at which time its cell voltage exceeded 10.0 volts.

EXAMPLE IV

A catalytic polymer anode was prepared by applying catalytic particles to an anode base consisting of a modified carbon loaded polyolefin with a copper core. The anode base was prepared by extruding a mixture of Union Carbide conductive thermoplastic compound DHDA 7707 with 15% by weight of added carbon fibers around a conductive copper core of #8 AWG wire. Addition of the carbon fibers had the effect of lowering the volumetric resistivity of the polymeric phase from 20 ohm-centimeters to 0.20 ohm-centimeters making possible operation at higher current density.

Catalytic particles containing 3% Ru by weight of titanium were prepared as described in Example II, and were then applied to the surface of the anode base by heating the anode base to 120° C. for 10 minutes and rolling the catalytic titanium particles onto the softened anode surface. The anode thus prepared contained 380 grams of said particles per square meter of anode surface.

A representative sample of this anode 2 centimeters long was operated in 1.0 Molar $H_2SO_4$ at 0.655 A, equivalent to a surface current density of 1000 amps per square meter. This anode operated for over 172 hours at a cell voltage of 3.1 to 3.2 volts without sign of failure.

This is a dramatic improvement over the conventional commercially available wire-shaped polymer anode which cannot be operated at such high current density at all, and which has a recommended operating current density maximum of only 0.5 amps per square meter.

Technical Applicability

Catalytic polymer electrodes according to the inention are especially suitable as anodes in impressed current cathodic protection systems to prevent corrosion damage of reinforced concrete structures, such as bridge decks, support members, parking garages, or buried or submerged steel structures such as gas and oil pipelines, offshore production platforms, fuel storage tanks, well casings.

We claim:

1. A cathodic protection system for pre-existing steel-reinforced concrete structures comprising a groove formed in the concrete, a catalytic polymer cable anode for impressed-current cathodic protection positioned in said groove and having a catalyst for operation of the anode at a reduced oxygen potential whereby the polymer of said cable anode is substantially protected from oxidation, a backfill material filling said anode-containing groove and an impressed current power source connected to said cable anode, said cable anode having a metallic core embedded in a non-catalytic, elongated current conducting polymer body forming the anode base, having fixed to the surface of said polymer body from about 10 to about 500 grams of catalytic particles per square meter of polymer body, said catalytic particles comprising mainly a valve metal of the group consisting of titanium, tantalum, niobium, zirconium and alloys and mixtures thereof, said valve metal particles containing catalyst in an amount from 0.1% to 5 0% by weight of valve metal, said catalyst being of precious metal or precious metal oxide selected from the group consisting of ruthenium, palladium, rhodium, iridium, platinum and mixtures thereof, in the metallic state or as an oxide.

2. The cathodic protection system of claim 1, wherein said anode base is formed of a carbon loaded polymer having dispersed therethrough up to 50% by weight conductive fibers.

3. The cathodic protection system of claim 1, wherein said anode base is made from a thermoplastic polymer selected from polyolefins, halocarbon polymers, styrenic polymers, polyamides, polyesters and acrylic resins.

4. The cathodic protection system of claim 1, wherein the metallic core contains copper.

* * * * *